US009234343B2

(12) United States Patent
Harper

(10) Patent No.: US 9,234,343 B2
(45) **Date of Patent: *Jan. 12, 2016**

(54) POST AND PANEL CONSTRUCTION

(71) Applicant: Trinity Post and Panel Inc., 100 Mile House (CA)

(72) Inventor: Kenneth Edward Creighton Harper, 100 Mile House (CA)

(73) Assignee: TRINITY POST AND PANEL INC., 100 Mile House (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/608,516

(22) Filed: Jan. 29, 2015

(65) Prior Publication Data

US 2015/0135616 A1 May 21, 2015

Related U.S. Application Data

(63) Continuation of application No. 13/817,035, filed as application No. PCT/CA2011/050358 on Jun. 14, 2011, now Pat. No. 8,973,320.

(60) Provisional application No. 61/401,620, filed on Aug. 17, 2010.

(51) Int. Cl.
*E04B 2/56* (2006.01)
*E04B 2/70* (2006.01)
(Continued)

(52) U.S. Cl.
CPC ... *E04B 1/26* (2013.01); *E04B 1/54* (2013.01); *E04B 2/702* (2013.01); *E04C 2/243* (2013.01);
(Continued)

(58) Field of Classification Search
CPC ..... E04B 2/56; E04B 2/562; E04B 2/70; E04B 2/702; E04B 2/703; E04B 2/705; E04B 2/707; E04B 2/708; E04B 2/80; E04B 1/18; E04B 1/26; E04B 1/54; E04B 1/2604; E04C 312/30
USPC ..... 52/233, 267, 270, 280, 282.1, 455, 456, 52/761, 780, 800.1, 800.12, 800.13, 831, 52/838
See application file for complete search history.

(56) References Cited

U.S. PATENT DOCUMENTS 1,247,107 A 11/1917 Graham
1,769,985 A * 7/1930 Coleman ..... 52/800.13
(Continued)

FOREIGN PATENT DOCUMENTS

DE 2348123 A * 4/1975
JP 2001214569 A 8/2001
JP 2006132106 A 5/2006

OTHER PUBLICATIONS

Trinity Post and Panel Inc.; Revolutionary construction company goes Global; http://www.trinitypostandpanel.com/wp-content/uploads/2010/09/Revolutionary-construction-company-goes-global1.pdf; available on the Internet as early as Sep. 2, 2010; retrieved from the Internet on Feb. 1, 2012.
(Continued)

*Primary Examiner* — Robert Canfield
(74) *Attorney, Agent, or Firm* — Blake, Cassels & Graydon LLP; Wilfred P. So

(57) ABSTRACT

An assembly for integrating an elongate structural member such as a post or a beam, and one or more panels is provided. The elongate structural member includes a notch defined within the elongate structural member. The notch includes a base surface and two side surfaces at opposite ends of the base surface. At least one of the side surfaces is tiered. The tiered side surface includes an inner portion and an outer portion that are substantially parallel to each other. The inner portion is substantially perpendicular and is adjacent to the base surface. The outer portion is offset from the inner portion and is positioned further away from the second side surface compared to the inner portion. A first panel is positioned within the notch and faces at least the base surface and the inner portion of the tiered surface. A second panel may be positioned within the notch.

23 Claims, 14 Drawing Sheets

(51) Int. Cl.

| | |
|---|---|
| ***E04B 1/26*** | (2006.01) |
| ***E04C 3/30*** | (2006.01) |
| ***E04B 1/61*** | (2006.01) |
| ***E04C 2/24*** | (2006.01) |
| ***E04C 3/36*** | (2006.01) |
| *E04C 3/12* | (2006.01) |

(52) U.S. Cl.
CPC ... *E04C 3/30* (2013.01); *E04C 3/36* (2013.01); *E04B 2001/266* (2013.01); *E04B 2001/2668* (2013.01); *E04C 3/12* (2013.01)

(56) References Cited

U.S. PATENT DOCUMENTS

| | | | | |
|---|---|---|---|---|
| 1,847,121 | A | | 3/1932 | Loetscher |
| 2,118,048 | A | | 5/1938 | Landsem |
| 3,527,005 | A | | 9/1970 | Slavens |
| 3,559,357 | A | | 2/1971 | Lowe |
| 4,265,068 | A | * | 5/1981 | Pomroy ..... 52/456 |
| 4,458,465 | A | | 7/1984 | Coe |
| 5,218,808 | A | | 6/1993 | Ardley |
| 5,271,204 | A | | 12/1993 | Wolf et al. |
| 5,339,583 | A | | 8/1994 | Hrdlicka et al. |
| 5,423,153 | A | * | 6/1995 | Woolems et al. ..... 52/233 |
| 5,577,356 | A | | 11/1996 | Hubbard et al. |
| 5,617,686 | A | | 4/1997 | Gallagher |
| D467,010 | S | | 12/2002 | Wrightman |
| 2009/0293373 | A1 | | 12/2009 | Klinkhamer et al. |

OTHER PUBLICATIONS

Vesely, Philip; International Search Report from corresponding PCT Application No. PCT/CA2011/050358; search completed on Sep. 20, 2011.

* cited by examiner

Example

POST AND PANEL CONSTRUCTION

CROSS-REFERENCE TO RELATED APPLICATIONS

The present application is a Continuation of U.S. application Ser. No. 13/817,035 filed on Jun. 14, 2011, titled "Post and Panel Construction", which is a national phase entry application of PCT Application No. PCT/CA2011/050358, filed on Jun. 14, 2011, titled "Post and Panel Constructions" and claims priority to U.S. Provisional Application No. 61/401,620 filed Aug. 17, 2010, and the entire contents of which are incorporated herein by reference.

TECHNICAL FIELD

This invention relates generally to post or beam construction with panels.

DESCRIPTION OF THE RELATED ART

Posts and beams have been used as support members for structures, for example, houses, buildings, and other shelters. Posts and beams are also popular in log-type buildings, for example log homes and log cabins, in which the posts and beams are cut logs or raw logs.

The term "post" as used herein generally refers to a substantially vertically oriented elongate structural member, such as a support column. The term "beam" as used herein generally refers to a substantially horizontal or substantially horizontally angled elongate structural member.

In many approaches to post and beam construction, the posts and beams are positioned apart from each other to form a frame and walls are constructed using the support of the frame. In some log constructions, two log posts are positioned apart from each other and horizontal logs are stacked against and between the two log posts to form a wall.

SUMMARY OF INVENTION

Non-limiting example embodiments of the invention are provided below.

In an example embodiment, an elongate structural member defines therein at least one notch, the notch comprising a base surface, and a first side surface and a second side surface that are at opposite ends of the base surface. The first side surface is tiered and the second side surface is not tiered. The tiered first side surface comprises an inner portion and multiple outer portions that are substantially parallel to each other, the inner portion being substantially perpendicular and immediately adjacent to the base surface and each of the multiple outer portions being offset from the inner portion and positioned increasingly further away from the base surface and increasingly further away from the second side surface. The notch is configured to receive at least a first panel and a second panel substantially parallel to each other, with at least the base surface and the inner portion of the tiered first surface configured to face the first panel, and at least one of the multiple outer portions of the tiered first side surface configured to substantially face the second panel.

In an example aspect of the elongate structural member, each of the multiple outer portions in the tiered first side surface is configured to accommodate an additional panel. In another example aspect of the elongate structural member, at least two notches are defined along the length of the elongate structural member and oriented substantially perpendicular to each other. In another example aspect the elongate structural member, a portion of the perimeter of the elongate structural member defined between the two notches is rounded.

In an example embodiment, an assembly is provided which integrates an elongate structural member and a panel. The elongate structural member has at least one notch defined within the elongate structural member, the notch comprising a base surface, and a first side surface and a second side surface that are at opposite ends of the base surface. The first side surface is tiered and comprises an inner portion and an outer portion that are substantially parallel to each other, the inner portion being substantially perpendicular and immediately adjacent to the base surface, and the outer portion being offset from the inner portion and positioned further away from the second side surface than the inner portion. The tiered first side surface comprises multiple outer portions, each of the multiple outer portions positioned increasingly further away from the base surface and increasingly further away from the second side surface. A first panel is positioned within the notch and is substantially facing at least the base surface and the inner portion of the tiered first side surface.

In an example aspect of the assembly, a second panel is positioned within the notch and is substantially parallel to the first panel, and the second panel is facing at least one of the multiple outer portions of the tiered first side surface. In another example aspect of the assembly, the second side surface of the notch is not tiered. In another example aspect of the assembly, the second side surface of the notch is tiered. In another example aspect of the assembly, each of the multiple outer portions in the tiered first side surface is configured to accommodate an additional panel. In another example aspect of the assembly, at least two of the notches are defined along at least part of the length of the elongate structural member and oriented substantially perpendicular to each other; and a portion of the perimeter of the elongate structural member defined between the two notches is rounded. In another example aspect of the assembly, the first panel comprises two boards and a polymer material located between the two boards. In another example aspect of the assembly, the two boards include at least one of oriented strand boards, magnesium oxide boards, hemp boards, vinyl boards and drywall. In another example aspect of the assembly, the polymer material comprises at least one of polyurethane and polyisocyanurate.

In an example embodiment, a kit of parts is provided for integrating an elongate structural member and a panel. The kit of parts comprises an elongate structural member having at least one notch defined within the elongate structural member, the notch comprising a base surface, and a first side surface and a second side surface that are at opposite ends of the base surface, wherein the first side surface is tiered and comprises an inner portion and multiple outer portions that are substantially parallel to each other, the inner portion being substantially perpendicular and immediately adjacent to the base surface, and each of the multiple outer portions being offset from the inner portion and positioned increasingly further away from the base surface than the inner portion and increasingly further away from the second side surface. The kit of parts further comprises a first panel that is configured to be positioned within the notch and to substantially face at least the base surface and the inner portion of the tiered first side surface.

In an example aspect of the kit of parts, a second panel is configured to be positioned within the notch and substantially parallel to the first panel, the second panel being in contact with at least the outer portion of the tiered first surface. In another example aspect of the kit of parts, the second side surface of the notch is not tiered. In another example aspect of the kit of parts, the second side surface of the notch is tiered.

In another example aspect of the kit of parts, each outer portion in the tiered first side surface is configured to accommodate an additional panel. In another example aspect of the kit of parts, at least two of the notches are defined along the length of the elongate structural member and oriented substantially perpendicular to each other; and a portion of the perimeter of the elongate structural member defined between the two notches is rounded. In another example aspect of the kit of parts, the first panel comprises two boards and a polymer material located between the two boards. In another example aspect of the kit of parts, the two boards include at least one of oriented strand boards, magnesium oxide boards, hemp boards, and vinyl boards, and drywall. In another example aspect of the kit of parts, the polymer material comprises at least one of polyurethane and polyisocyanurate.

BRIEF DESCRIPTION OF THE DRAWINGS

Embodiments of the invention or inventions are described, by way of example only, with reference to the appended drawings wherein.

DETAILED DESCRIPTION

Figure 1:
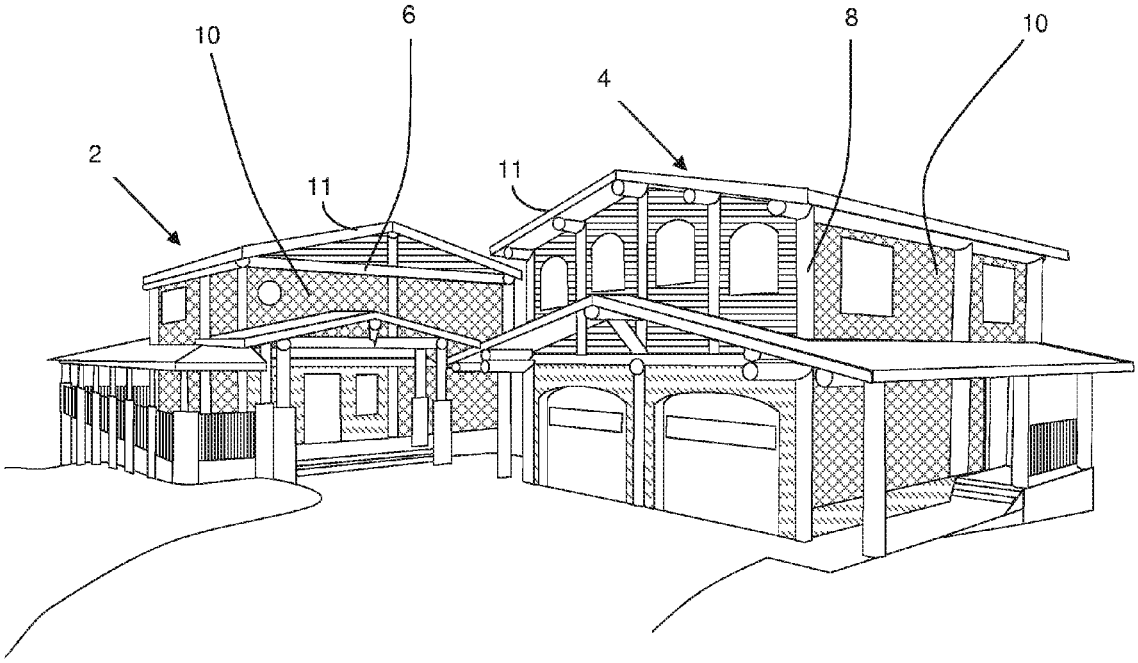
FIG. 1 is a perspective view of buildings constructed using elongated members integrated with panels.

It will be appreciated that for simplicity and clarity of illustration, in some cases, reference numerals may be repeated among the figures to indicate corresponding or analogous elements. In addition, some details or features are set forth to provide a thorough understanding of the embodiments described herein. However, it will be understood by those of ordinary skill in the art that the embodiments described herein are illustrative examples that may be practiced without these details or features. In other instances, well-known methods, procedures and components have not been described in detail so as not to obscure the invention illustrated in the examples described herein. Also, the description is not to be considered as limiting the scope of the example embodiments described herein or illustrated in the drawings.

In an example embodiment, the proposed elongate structural member defines therein at least one notch. The notch includes a base surface and two side surfaces at opposite ends of the base surface. The first side surfaces is tiered. The tiered first side surface includes an inner portion and an outer portion that are substantially parallel to each other. The inner portion is substantially perpendicular and immediately adjacent to the base surface. The outer portion is offset from the inner portion and positioned further away from the second side surface than to the inner portion. In other words, the distance between the outer portion and the other side surface is greater than the distance between the inner portion and the other side surface. The notch is also configured to receive at least a first panel and a second panel that can be positioned substantially parallel to each other within the notch. At least the base surface and the inner portion of the tiered first surface are able to contact the first panel, and at least the outer portion of the tiered surface able to contact the second panel.

It is appreciated that an elongate structural element can refer to a post, a beam, or a strut, and may be made of various materials. Non-limiting examples of materials include a log, concrete, metal, and composites.

Many post and beam constructions use logs to form walls between two posts. Logs are typically substantially cylindrically-shaped. The logs are substantially horizontally oriented and stacked vertically on top of each other to form a wall. A wall formed of many logs results in a rippled or bumpy wall surface. In many cases, the sides of the logs are flattened. The elongate flattened sides of each log may be oriented to face the same direction in order to form a flat-faced wall. The flat-faced wall is desirable if additional paneling (e.g. siding) is to be placed against the wall, since the flat-face allows for more contact between the paneling and the wall. Flattening the logs is a time-consuming and expensive process.

The logs that form the walls may also not be uniform. The logs may shrink or expand over time due to different weather conditions and change in moisture content. This variability in sizing and shape can cause cracks to form between the logs and the posts, which may lead to air, water, and other weather leaks in the wall. This often leads to more frequent repairs to the log walls.

Logs are cut to exact dimensions in order to reduce the possibility of having cracks or leaks formed between the logs. This process is costly and time-consuming.

Another approach is to cover or seal cracks between the logs by placing trim or moulding between the logs. The trim is typically scribed or cut by a skilled tradesperson to match the log contours. The process of fabricating and installing the trim is costly and time-consuming.

Panels have been used to form walls instead of stacking horizontal logs. However, in such circumstances, many post and panel constructions result in posts and beams with rectangular-shaped cross-sections. This is sometimes undesirable, since building owners prefer the aesthetics of rounded posts and beams.

The proposed post and panel construction as described herein addresses such difficulties by providing an elongate structural member that can easily interface with two or more panels. In particular, the elongate structural member includes a tiered notch that allows one panel to be slotted into the notch, and another panel, which may be an exterior siding panel or an interior finishing panel, to be slotted into the notch as well.

In FIG. 1, two representative buildings 2 and 4 are shown constructed with posts and panels. The beams 6 extend horizontally and the posts 8 extend upwardly. The panels are used to form the walls 10 and roof 11 number of the buildings 2, 4. As discussed below, the elongate structural members, namely beams 6 and posts 8, have notches that are used to integrate the panels 10 with the elongate structural members. The panels (e.g. the walls 10 and the roof 11) shown are typically, although not necessarily, exterior siding panels which can have different textured finishes. Non-limiting examples include cedar, Hardie™ board, vinyl siding, stucco, stone, and cultured stone. A panel, for example, may also be made of multiple panel pieces that are assembled together.

Figure 2:
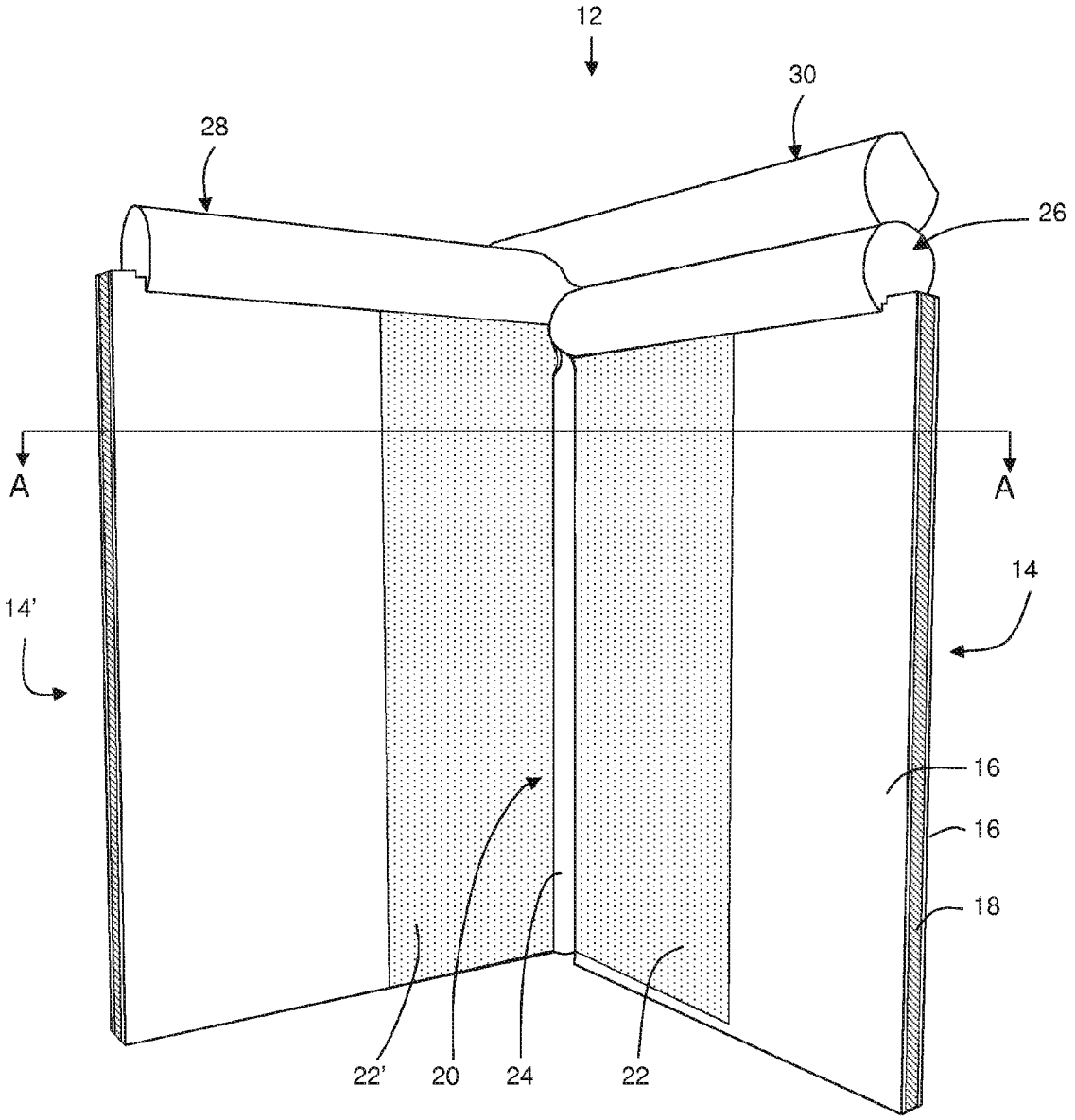
FIG. 2 is a perspective view of a corner post and panel assembly.

In FIGS. 2, 3, 4 and 5, different views of an example corner assembly 12 are shown. Such a corner assembly 12 can be used to form a building, such the buildings 2, 4 shown in FIG. 1. Two panels 14 and 14' are shown integrated with a post 20 and three beams 26, 28, 30. The assembled configuration is shown in FIG. 2. Also shown is another set of panels 22 and 22', covering panels 14 and 14', respectively. If the corner assembly 12, as shown in FIG. 2, were part of a building's interior, for example, the other set of panels 22, 22' would be interior finishes. If the corner assembly 12, as shown in FIG. 2, were part of an exterior of a building, for example, the other set of panels 22, 22' would be exterior siding. The curved surface 24 of the post 20 can also be seen.

The panel 14 can be, for example, a composite panel. For example, as shown in FIG. 2, the panel 14 is a structurally insulated panel (SIP). The panel 14 includes two boards 16 with a polymer material 18 situated between the fibre boards 16. The boards 16 can be oriented strand or fibre boards, also commonly referred to as oriented strand boards (OSB). The boards 16 may also be of different materials, such as for example, magnesium oxide, plywood, hemp board, drywall, tin, or metal, or combinations thereof. The polymer material 18, for example, is polyurethane (PUR) or polyisocyanurate (PIR), or a mixture of both. Such a polymer blend has a high thermal resistance R value, for example R28. In other words, a material can be selected that will provide high insulation. The boards 16 provide further structural integrity to the panel 14. Such a composite panel will increase the insulation in the wall and thereby save costs for heating or cooling a building constructed by the post/beam and panel system, as described herein.

The SIP can be manufactured by spraying the polymer material between the two boards 16. The polymer material then cures and hardens, forming the SIP (e.g. composite panel) 14. The use of glue is not required to form the SIP since the polymer material bonds the boards 16 together. The finished SIP is a unitary structure. In an example embodiment when used to form walls, the composite panel 14 may be approximately 4.5 inches thick. When used to form a roof, for example, the composite panel 14 may be approximately 6.5 inches thick.

It will be appreciated that the panel 14 can have different constructions and need not be of a composite construction. For example, the panel 14 can be of a uniform composition.

The panel 22 is for siding or finishing and covers the panel 14, and its selection may depend on whether the panel 22 is used for interior or exterior applications. In both applications, the panel 22 can be used for aesthetic or structural purposes, or both.

For exterior applications, the panel 22 may be a siding panel used for weather-proofing purposes to protect against weather, for example moisture and wind. A siding panel can have different have finishes. Similar characteristics can apply to siding panel 22'.

For interior applications, the panel 22 may be a finish that is exposed to the interior of the building. Non-limiting examples of such a finish may be dry-wall material, tiling, and mirrors. Similar characteristics can apply to siding panel 22'.

Figure 3:
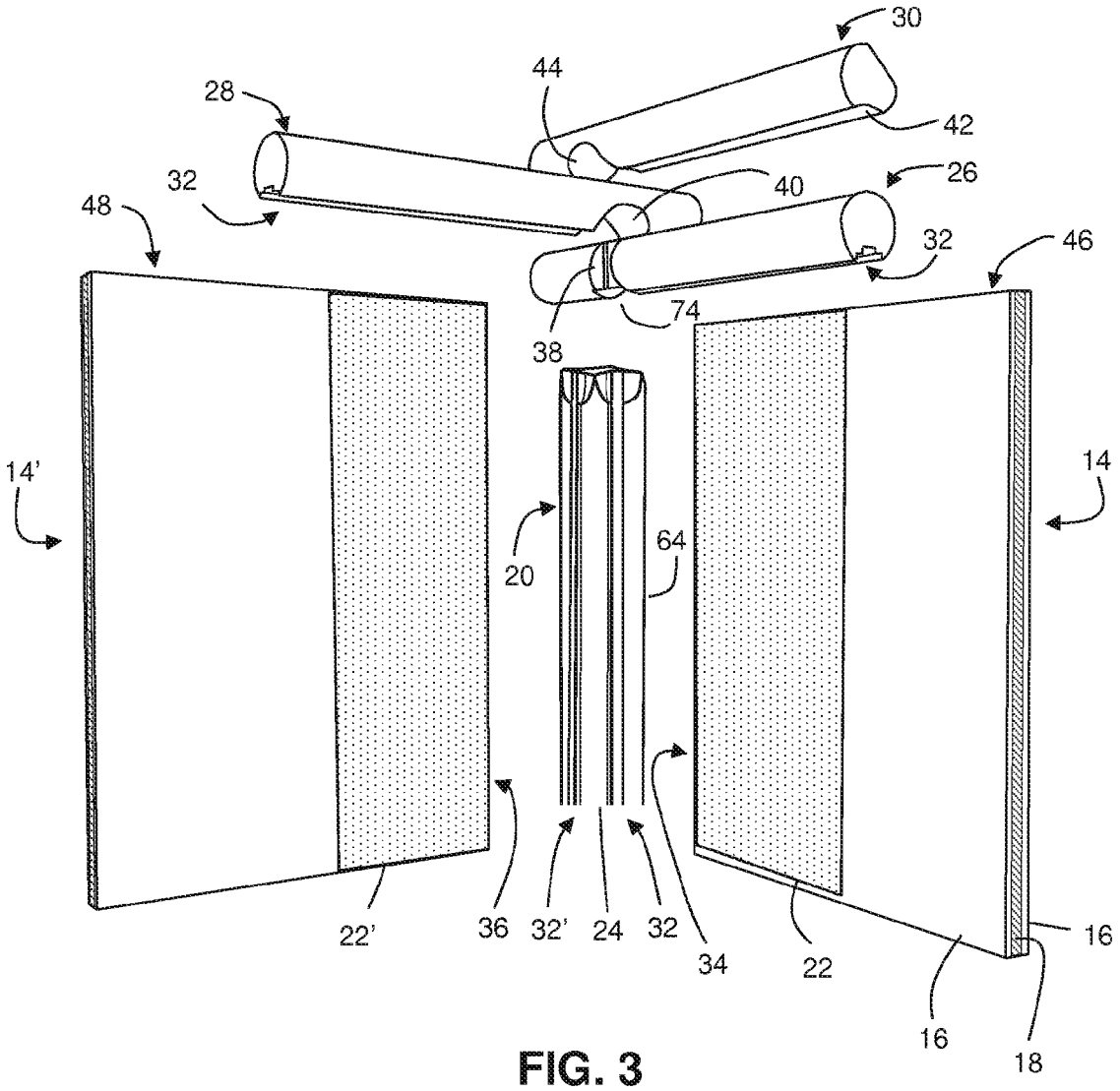
FIG. 3 is an exploded perspective view of the post and panel assembly of FIG. 2.

In the exploded view of FIG. 3, it is more clearly seen that the beams 26, 28 and 30 are integrated in an overlapping manner. In particular, the post 20 has notches 32 and 32' that extend vertically along its length. The notches 32 and 32' each have at least one tiered side wall 64 that can accommodate at least two panels. The tiered side wall 64 is described in further detail below, for example, in FIG. 6.

Continuing with FIG. 3, the vertical edge 34 of the panel 14 and the siding panel 22 are inserted into the notch 32 of the post 20. The vertical edge 36 of the panel 14' and the siding panel 22' are inserted into the notch 32' of the post 20.

The upper horizontal edge 46 of the panel 14 and the siding 22 are inserted into the notch 32 of the beam 26. The notch 32 of the beam 26 extends horizontally along its length.

The beam 26 also includes another notch 38 that also has at least one tiered side wall 74. The tiered side wall 74 is described in further detail below, for example in FIG. 7. The notch 38 extends along the width of the beam, in this example in a vertical orientation. As can be seen more clearly in FIG. 4, the upper portion of the vertical edge 36 of the panel 14' and the siding 22' can be inserted into the notch 38.

The upper horizontal edge 48 of the panel 14' and the siding 22' can be inserted into the notch 32 extending along the length of the beam 28.

The beams 28 and 30 have notches 40, 42 and 44 to accommodate overlapping of the beams. For example, if the beams 26, 28 and 30 are rounded, the notches 40, 42 and 44 are also rounded to accommodate the rounded profile of the beams. In particular, notch 40 extends across the width of beam 28 and interfaces with beam 26. Notch 44 extends across the width of beam 30 and interfaces with beam 28. Notch 42 extends along the length of beam 30 and interfaces with beam 26.

Figure 4:
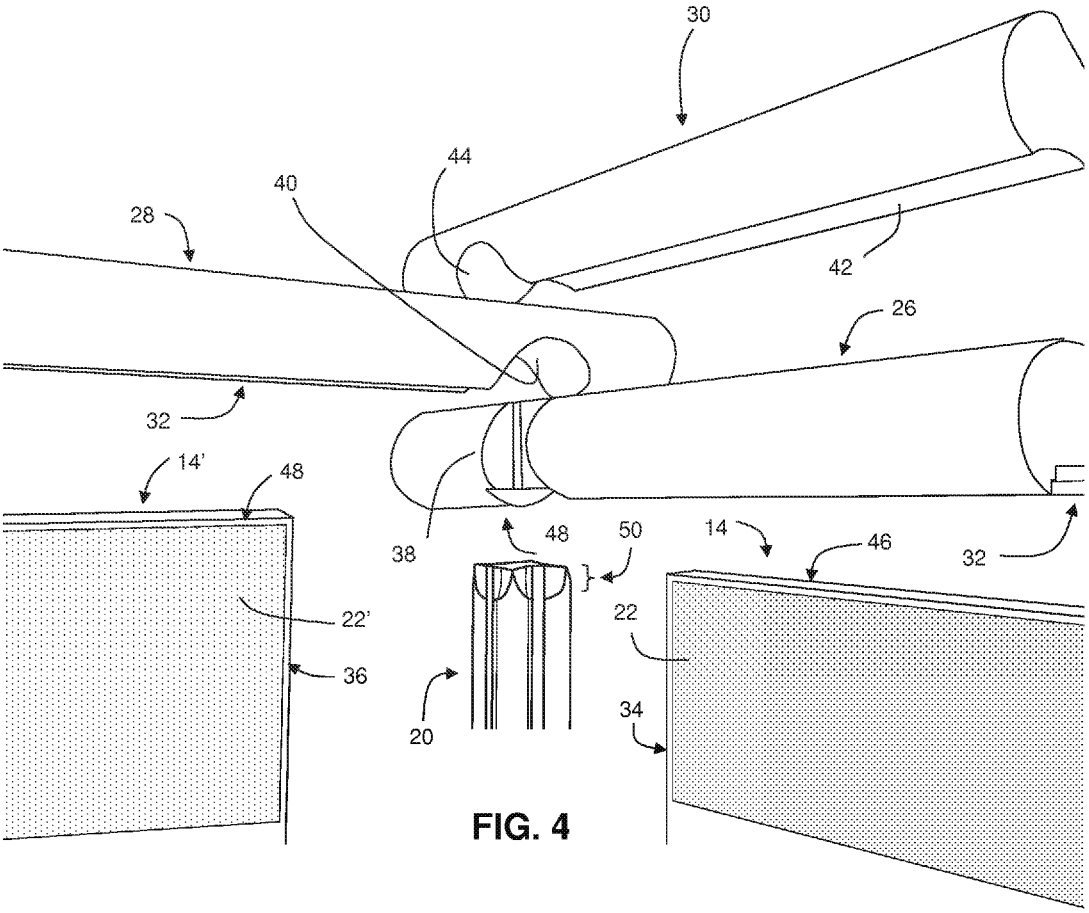
FIG. 4 is an enlarged partial view from the interior of the exploded perspective view of FIG. 3 showing notches in posts and beams.
Figure 5:
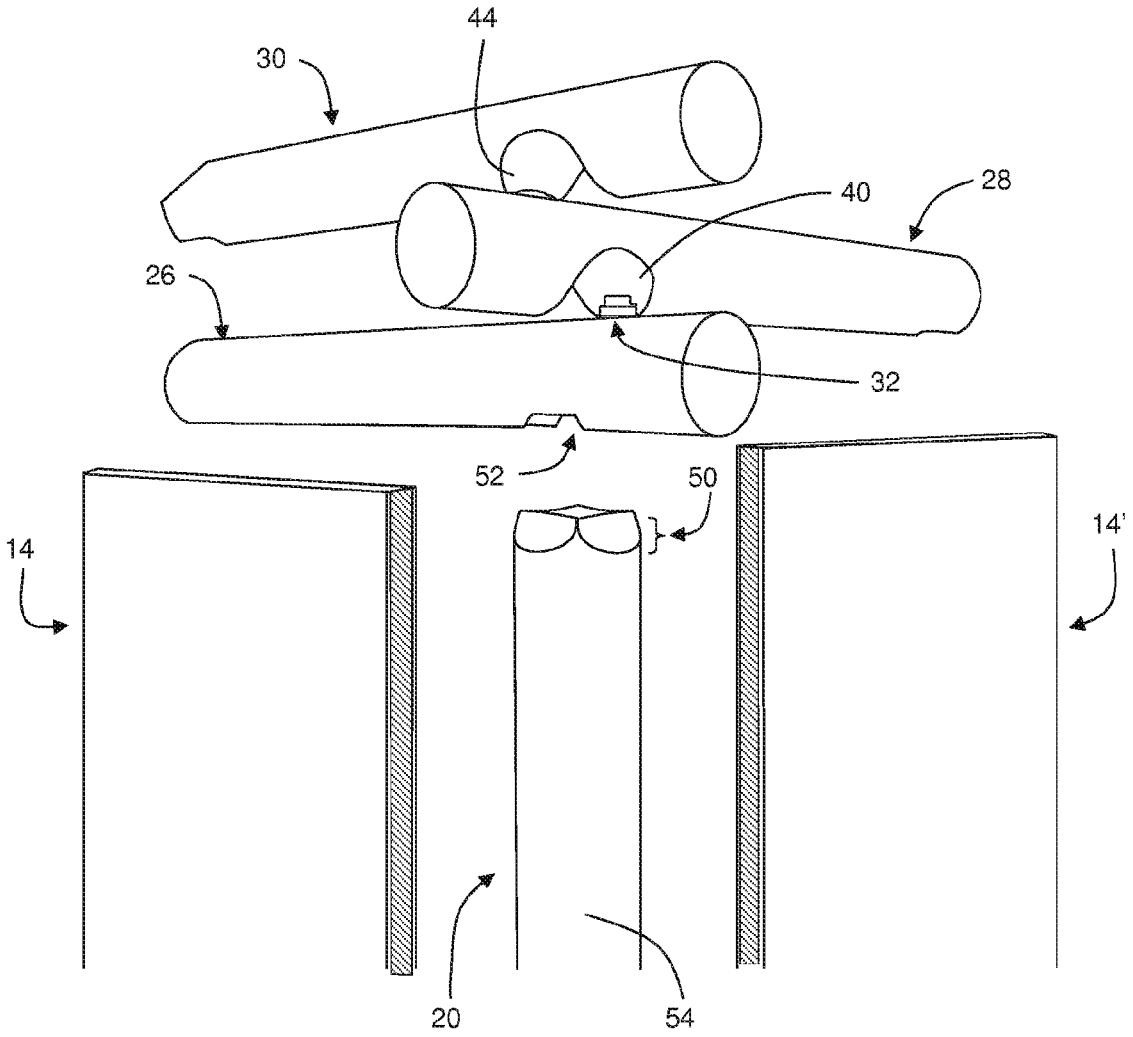
FIG. 5 is another exploded perspective view from the exterior of the post and panel assembly of FIG. 2.

As can be better seen in FIGS. 4 and 5, the upper portion 50 of the post 20 is tapered. For example, the post can be tapered to have a rectangular or square cross-section. As seen in FIG. 5, the rounded surface 54 of the post 20 is tapered to a rectangular or a square cross-section at the upper portion 50.

The upper portion 50 of the post 20 is inserted into another notch 52 of the beam 26. The notch 52 is of complementary shape to the upper portion 50 of the post 20. Other features of the notches 32, 38 and 52 are discussed below.

Figure 6:
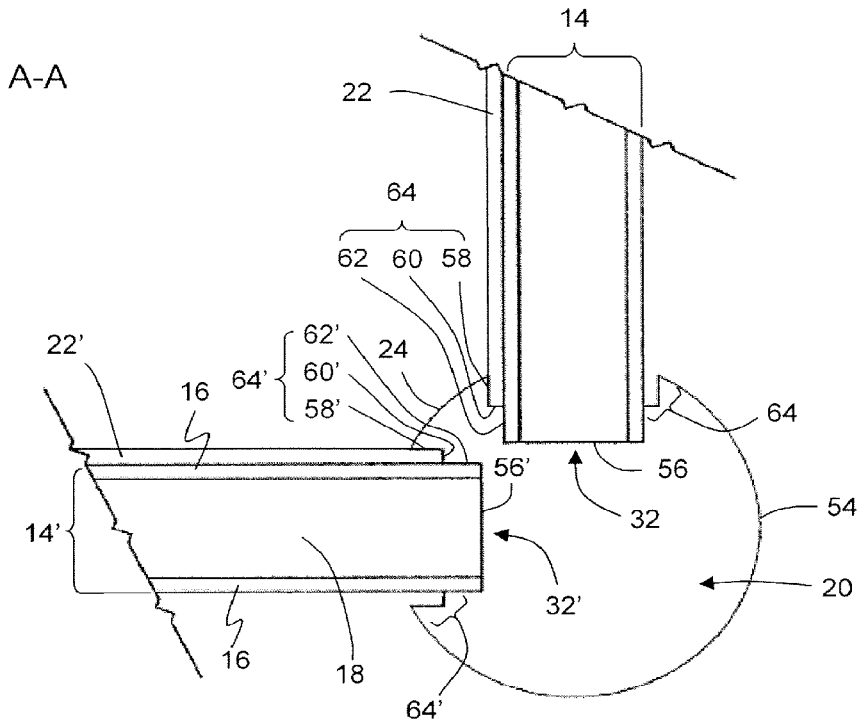
FIG. 6 is a cross-sectional view of the corner assembly of FIG. 2 taken along line A-A.

Turning to FIG. 6, a cross-sectional view of the corner assembly 12 along the line A-A of FIG. 2 is shown. The cross-sectional view shows the elongate structural member 20 integrated with two panels 14, 14'. It will be appreciated that this configuration can have different orientations. For example, if the elongate structural member 20 is oriented vertically, the structural member 20 is a post with two panels 14, 14' forming walls, for example in a corner of a room as shown in FIG. 2. In another example, if the structural member 20 is oriented horizontally, then the structural member 20 is a beam integrated with a vertically oriented panel 14 and a horizontally oriented panel 14'.

The two notches 32 and 32' are oriented in an angled position relative to each other along the structural member 20. For example, the angled position of the notches 32 and 32' may be perpendicular to each other, so that the panels 14 and 14' are also in a perpendicular position to each other when inserted into the notches 32 and 32'.

The notches 32 and 32' each include a base surface 56 and 56', respectively, and two side surfaces, with at least one of the side surfaces being a tiered side surface. Notch 32 has two side surfaces 64 that are both tiered. Notch 32' also has two side surfaces 64' that are both tiered. Although many of the figures shown herein include notches 32 with two side surfaces that are tiered, in other configurations one of the side surfaces may be tiered and the other side surface may not be tiered.

The elongate structural member 20 may, for example, have a cross-sectional width of approximately 12 inches to 14 inches. If the elongate structural member 20 is circular, like a log, then the diameter may be approximately 12 inches to 14 inches.

The tiered side surface 64 includes an inner portion 62 and an outer portion 58. The inner portion 62 of the tiered surface 64 is immediately adjacent to, and substantially perpendicular with the base surface 56. The outer portion 58 of the tiered side surface 64 is positioned further out from the base surface 56 and is offset from the inner surface 62. In the example embodiment shown, the outer portion 58 and the inner portion 62 are substantially parallel to each other.

The base surface 56 and the inner portion 62 of the tiered surface 64 are in contact with the panel 14. The panel 14 is positioned within the most inner tier of the notch 32. The offset outer portion 58 and ledge 60 form another tier in the notch 10. Another panel 22 (e.g. siding or finishing) can be inserted into this tier of the notch 32. Panel 22 is in contact with the outer portion 58 and ledge 60.

In this example configuration, two of the notches 32, 32' are defined along the length of the elongate structural member 20 and are oriented substantially perpendicular to each other. Furthermore, a portion of the perimeter surface 24 of the elongate structural member defined between the two notches is rounded.

This configuration allows for the rounded surfaces 24 and 54 of the elongate structural member 20 to be exposed. For example, the rounded surface 24 may be the inside corner of a room with wall panels 14' and 14. It may be desirable to see the rounded surface 24 while located inside the room.

Figure 7:
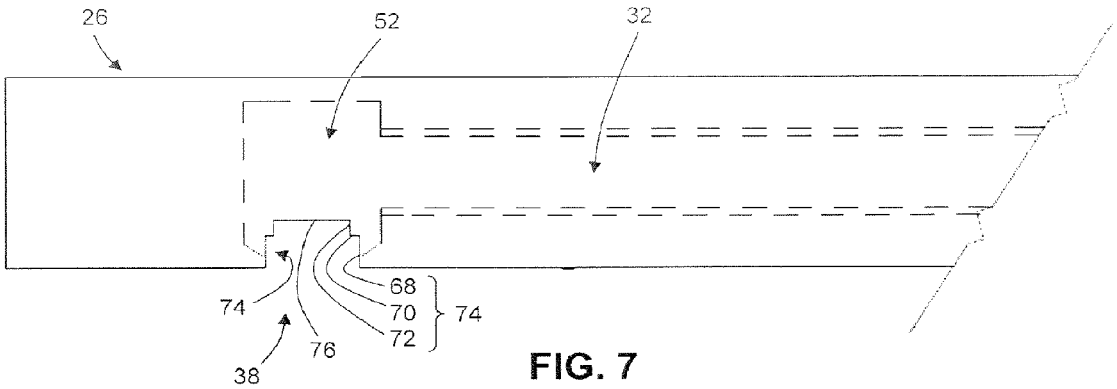
FIG. 7 is a side view of an elongated structural member depicting a tiered notch along its length, a tiered notch along its width, and a notch for receiving a post.
Figure 8:
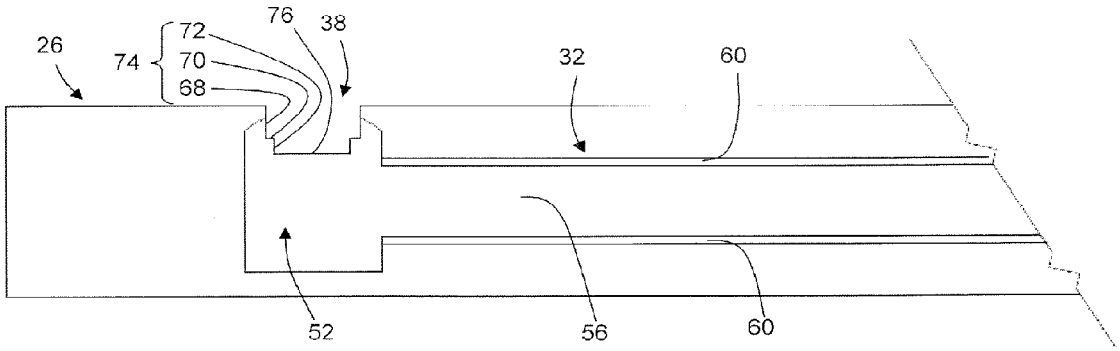
FIG. 8 is another side view of the elongated structural member shown in FIG. 7, with the view facing into the tiered notch along its length and facing into the notch for receiving the post.
Figure 9:
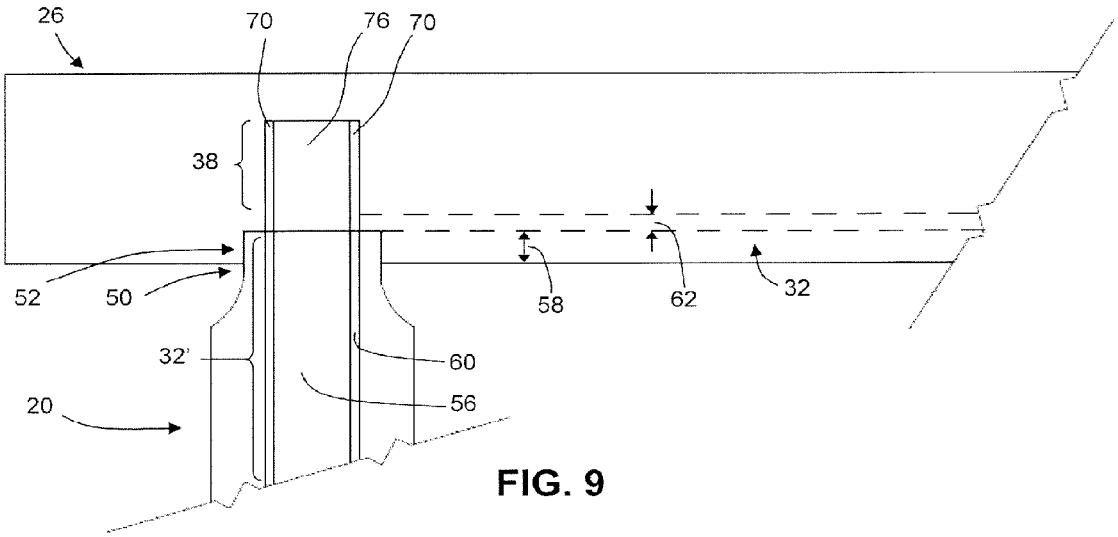
FIG. 9 is another side view of the elongated structural member shown in FIG. 7, depicting a post inserted into the notch for receiving the post.

Turning to FIGS. 7, 8 and 9, the beam 26 is shown with notches 32, 38 and 52 from different views. FIGS. 7 and 8 show the beam 26 in isolation and FIG. 9 shows the beam 26 integrated with the post 20. As discussed above, notches 38 and 32 are for receiving panels. Notches 38 and 32 have at least one tiered side surface to accommodate two or more panels.

Notch 32 includes a base surface 56 and two side surfaces, with at least one being a tiered side surface. The tiered side surface includes an inner portion 62, a ledge 60 and an outer portion 58. Notch 32 extends along the length of the beam 26.

Notch 38 extends along the width of the beam 26 and also includes a base surface 76 and two side surfaces. At least one of the side surfaces is a tiered side surface 74, which includes an inner portion 72, a ledge 70 and an outer portion 68. Similar to notch 32, the tiered side surface 74 allows a first panel to be received and in contact with the base surface 76 and the inner portion 72. A second panel can also be received in the notch 38 with the second panel being in contact with the ledge 70 and outer portion 68.

Notch 52 is configured to receive the upper portion 50 of the post 20, as shown in FIG. 9. The space defined by the notch 52 extends to the space defined by the notch 38 and the space defined by the notch 32.

In FIG. 9, when the post 20 is inserted into the notch 52, the space defined by the vertical notch 32' of the post 20 extends upwardly to the space defined by the notch 38 of the beam 26. The profiles of the notch 32' and the notch 38 are, for example, identical, so that a panel 14' and siding 22' can be inserted into both notches 32' and 38. This is shown in the exploded view in FIG. 3.

Figure 10:
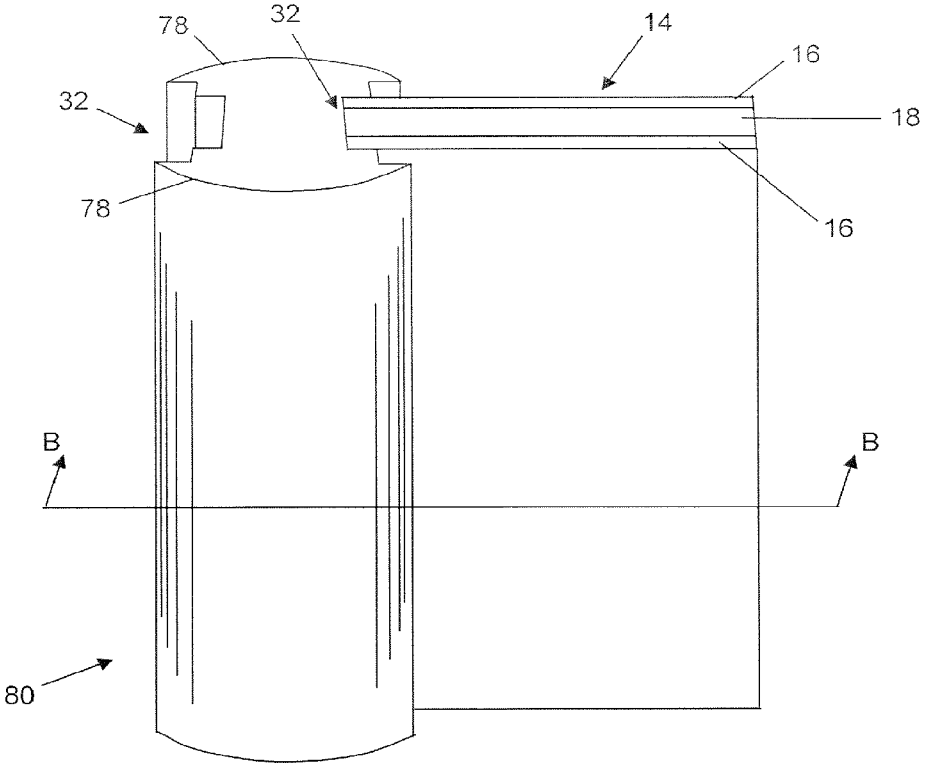
FIG. 10 is a perspective view of an elongated structural member integrated with a panel.

In FIG. 10, a perspective view of an elongate structural member 80 is shown integrated with a panel 14. The structural member 80 may have rounded surfaces 78, such as the surfaces of a log post or log beam. In this embodiment, there are two notches 32 in the structural member 80. The notch 32 may extend along the length of the elongate structural member 80, as shown. In another example, the notch 32 may extend along the width of the elongate structural member 80, similar to the notch 38 in FIG. 3 that extends along the width of the beam 26.

Figure 11:
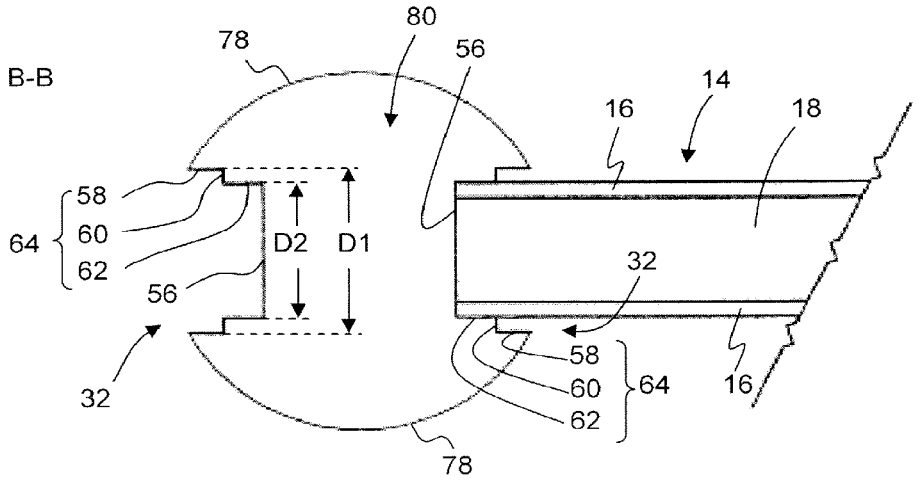
FIG. 11 is a cross-sectional view of the assembly of FIG. 10 taken along line B-B.

FIG. 11 shows the cross-sectional view of an elongate structural member 80 and panel 14 along the line B-B in FIG. 10. Each notch 32 includes a base surface 56 and two side surfaces, with at least one of the side surfaces being a tiered side surface 64. For example, there is a tiered first side surface and a second side surface that may or may not be tiered. Although many of the figures shown herein include notches 32 with two tiered side surfaces 64, in other configurations one of the side surfaces is tiered and the other side surface is not tiered.

A tiered side surface 64 includes an inner portion 62 and an outer portion 58, which are offset from each other, for example, by a ledge 60. The distance between the outer portion 58 of the tiered side surface 64 and the other side surface, shown as "D1" in FIG. 11, is greater than the distance between the inner portion 62 and the other side surface, illustrated as "D2" in FIG. 11.

The base surface 56 and the inner portion 62 of the tiered surface 64 are in contact with the panel 14, so that the panel 14 is positioned within the most inner tier of the notch 32. The offset outer portion 58 and the ledge 60 form another tier in the notch 32. Another panel or siding can be inserted into this tier of the notch 32.

Figure 12:
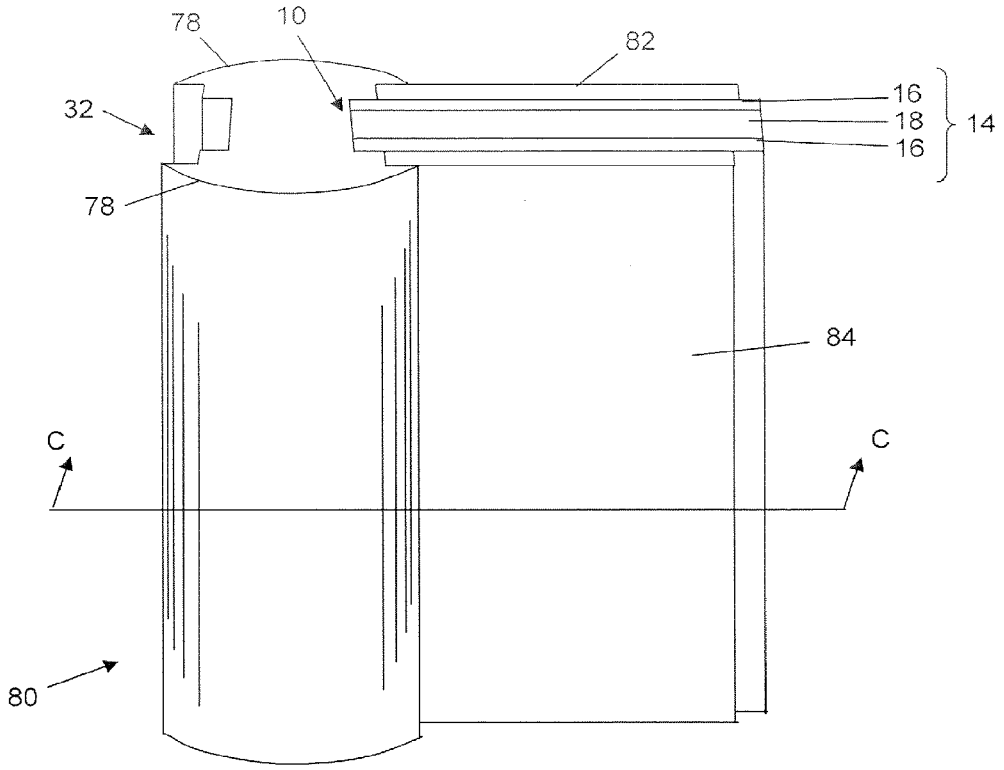
FIG. 12 is a perspective view of an elongated structural member integrated with three panels.

For example, in FIG. 12, the panel 14 is shown in the inner tier of the notch 32. A second panel 82, for example a siding or finishing panel, is shown positioned next to one side of the first panel 14. A third panel 84, siding or finishing panel, is shown positioned next to the other side of the first panel 14. All three of the panels 14, 82 and 84 are integrated into the notch 32.

Figure 13:
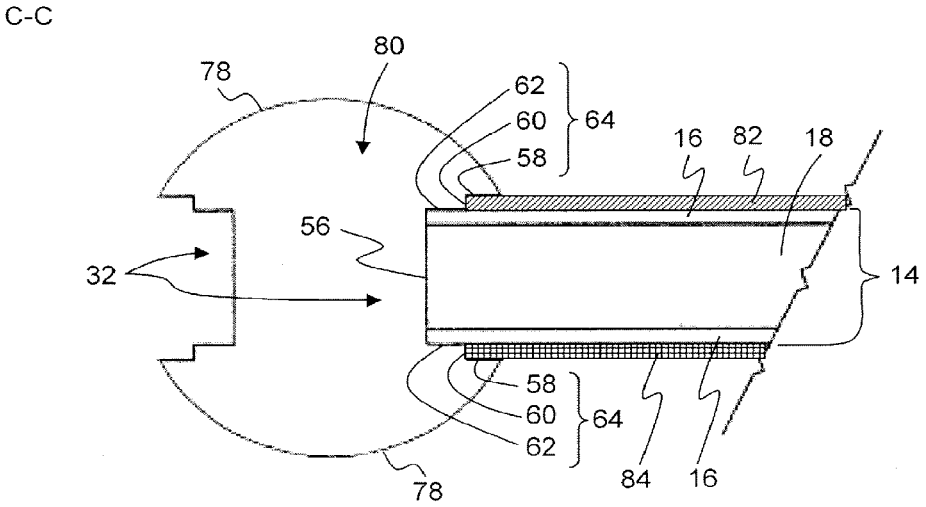
FIG. 13 is a cross-sectional view of the assembly of FIG. 12 taken along line C-C.

As seen more clearly in FIG. 13, showing the cross-section along the line C-C in FIG. 12, the second panel 82 is slotted into the other tier of the notch 32, and is in contact with the first panel 14 and the outer portion 58 of the tiered side surface 64. The first panel 14 is nestled deeper within the elongate structural member 80 than to the second panel 82 due to the configuration of the tiered side surface 64 of the notch 32.

As the notches 32 each include two tiered side surfaces 64, two panels, in addition to the first panel 14, can be placed in notch 32. The third panel 84 is placed adjacent to, and generally parallel with, the first panel 14. A portion of the third panel 84 is nestled between the first panel 14 on one side of the panel 84, and the notch's ledge 60 and the outer portion 58 of the side surface 64 on the other side of the panel 84.

Although an outer panel is shown on each side of the first panel 14, in certain embodiments, an outer panel may be positioned only on one side of the first panel 14. In yet other embodiments, there may be multiple outer panels positioned against a side of the first panel 14. There may also be multiple tiers in the side surface 64 of the notch 32 to accommodate the multiple outer panels.

The basic configurations shown in FIGS. 10, 11, 12 and 13, and variations thereof, can be used in different orientations to form walls, roofs, floors, and other structures.

Figure 14:
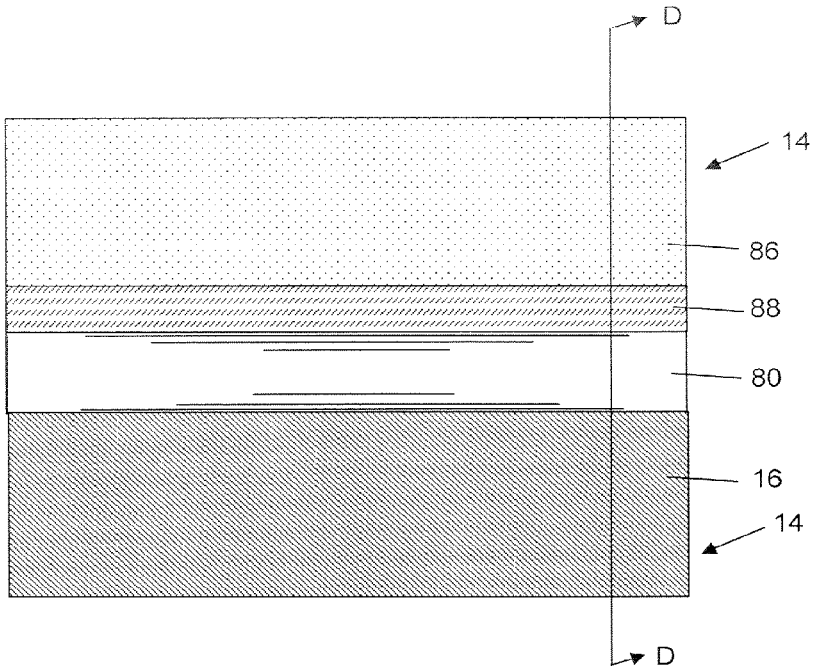
FIG. 14 is an elevation view of an elongated structural member integrated with two panels and including a flashing.

In FIG. 14, an example of an elongate structural member 80 is shown in a horizontal orientation and functions as a beam. The beam 80 is positioned between a panel 14 located above, and another panel 14 located below.

Figure 15:
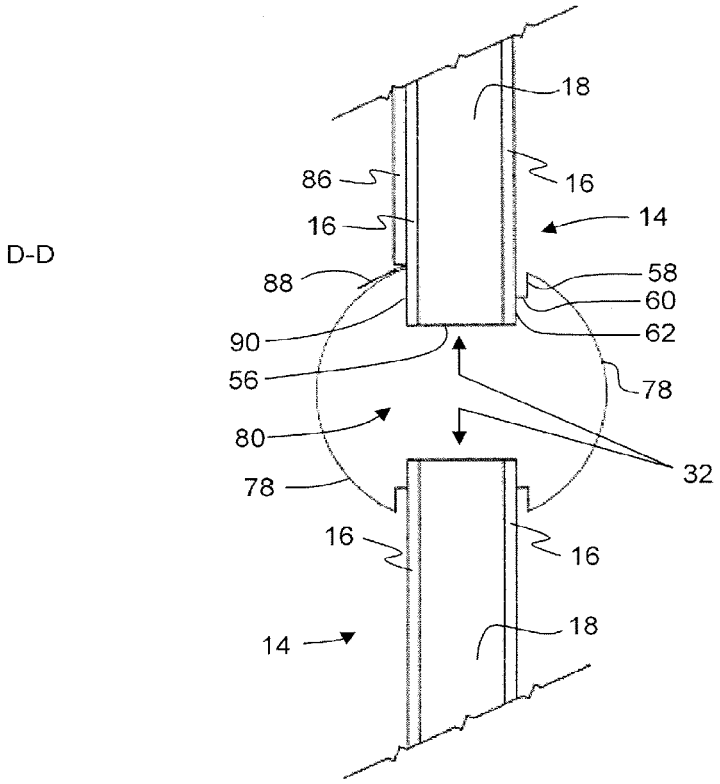
FIG. 15 is a cross-sectional view of the assembly of FIG. 14 taken along line D-D.

This is shown more clearly in the cross-sectional view in FIG. 15, taken along line D-D in FIG. 14. A siding panel 86 is shown covering the panel 14 above. The panels 14 are nestled or fitted into the two notches 32 that extend along the length of the beam 80. In such a configuration, the panels 14 located above and below the beam 80 are also called gable walls.

The notches 32 also include tiered side surfaces to hold multiple panels. One side surface 64 is tiered, including the inner portion 62, ledge 60 and outer portion 58, while the other side surface 90 is not tiered. The non-tiered side surface 90 can be, for example, flat. The exterior panel 86 is positioned against the panel 14 and is on the same side of the notch 32 as the non-tiered surface 90. The exterior panel 86 is not nestled within the notch 32.

Flashing 88 is also placed at the bottom of the exterior panel 86 and along the upper portion of the beam 80. "Flashing" typically comprises thin continuous pieces of impervious material such as sheet metal, installed to prevent the passage of water into a structure from an angle or joint. The flashing 88 is angled downwardly and is used to direct or shed precipitation and debris over the upper portion of the beam 80. This helps to reduce or prevent precipitation and debris from entering into spaces, if any, in the notch 32, whereby the spaces are defined between the non-tiered side surface 90 and the side of the panel 14.

Figure 16:
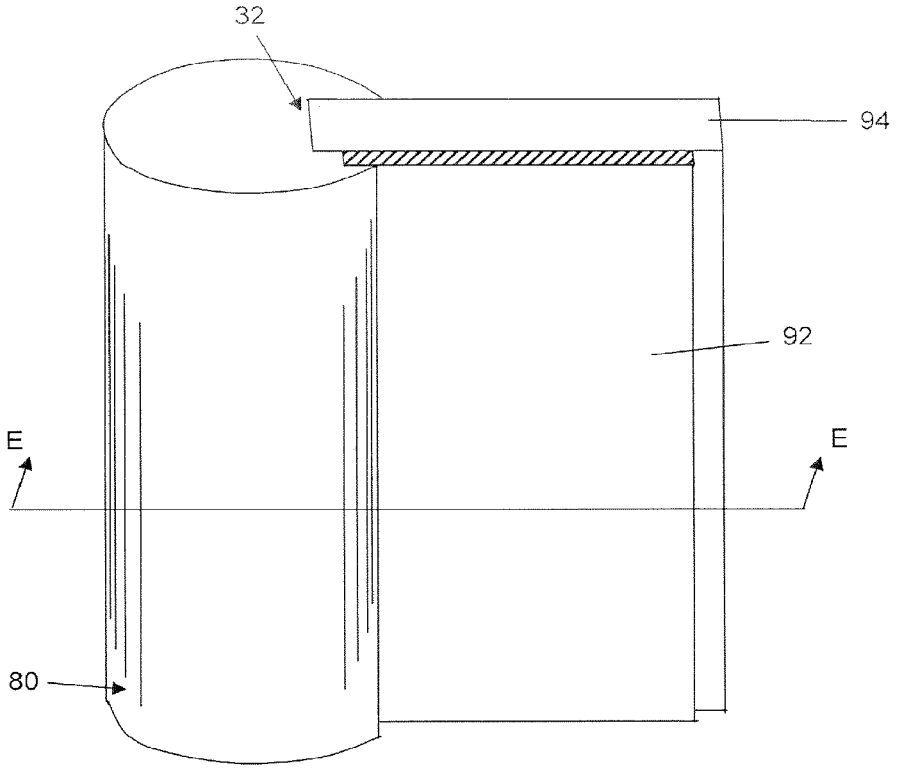
FIG. 16 is a perspective view of an elongated structural member with a notch having one tiered side surface and one non-tiered side surface, and depicting two panels inserted into the notch.
Figure 17:
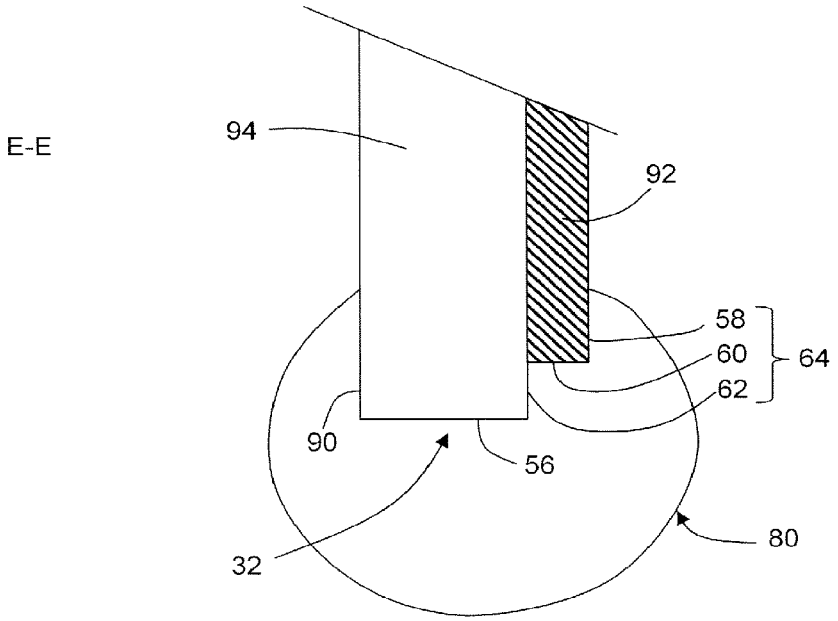
FIG. 17 is a cross-sectional view of the elongated structural member and the two panels shown in FIG. 16 taken along line E-E.

In FIG. 16, another example embodiment of an elongate member 80 is shown having a notch 32. The notch 32 has inserted therein a first panel 94 and a second panel 92. Turning to FIG. 17, a cross-sectional view is shown taken along line E-E in FIG. 16. The notch 32 has a base surface 56 and two side surfaces 64, 90. One side surface 90 is not tiered. The other side surface 64 is tiered and can accommodate a panel 92, for example a siding or finishing panel, in addition to the panel 94. It can be appreciated that the notch 32 can therefore have various configurations. It will also be appreciated that the panels 92 and 94 may or may not be SIPs.

Figure 18:
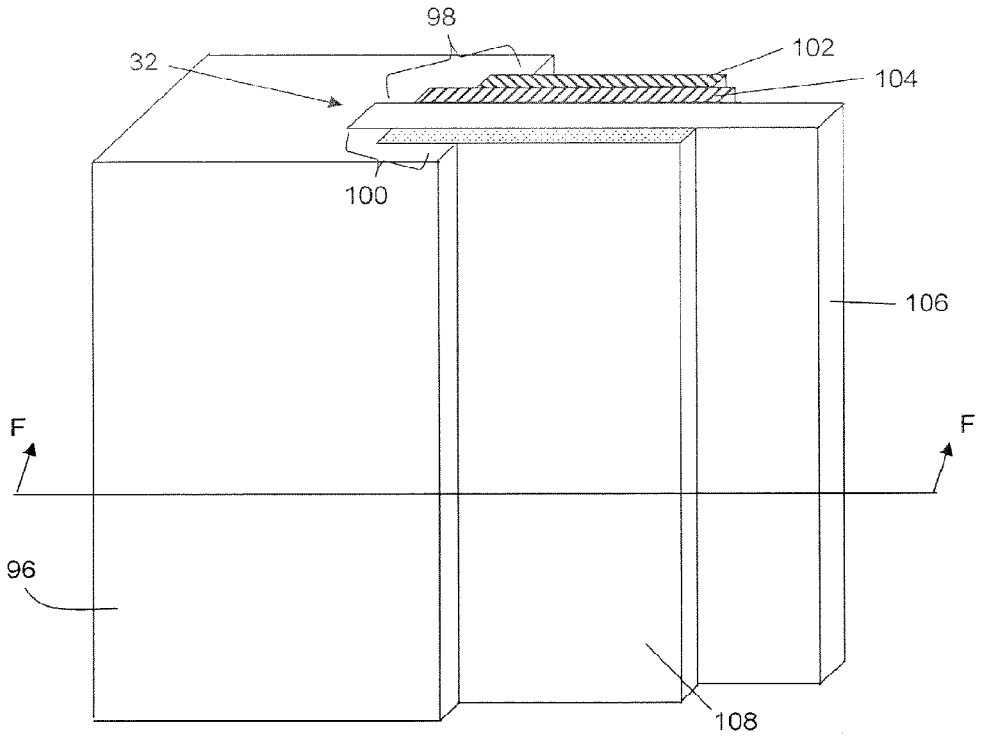
FIG. 18 is a perspective view of an elongated structural member with a notch depicting two tiered side surfaces, with one tiered side surface having more tiers than the other tiered side surface, and depicting four panels inserted into the notch.

FIG. 18 shows another example embodiment of an elongate member 96 that has a rectangular shaped cross-section. The elongate member 96 has defined therein a notch 32 having two side surfaces 98 and 100. Both side surfaces 98, 100 are tiered surfaces. The notch 32 has inserted therein four panels 102, 104, 106 and 108.

It will be appreciated that the elongate member 96 may have different cross-sectional profiles, such as, for example, circular, rectangular, elliptical, pentagonal or triangular profiles.

Figure 19:
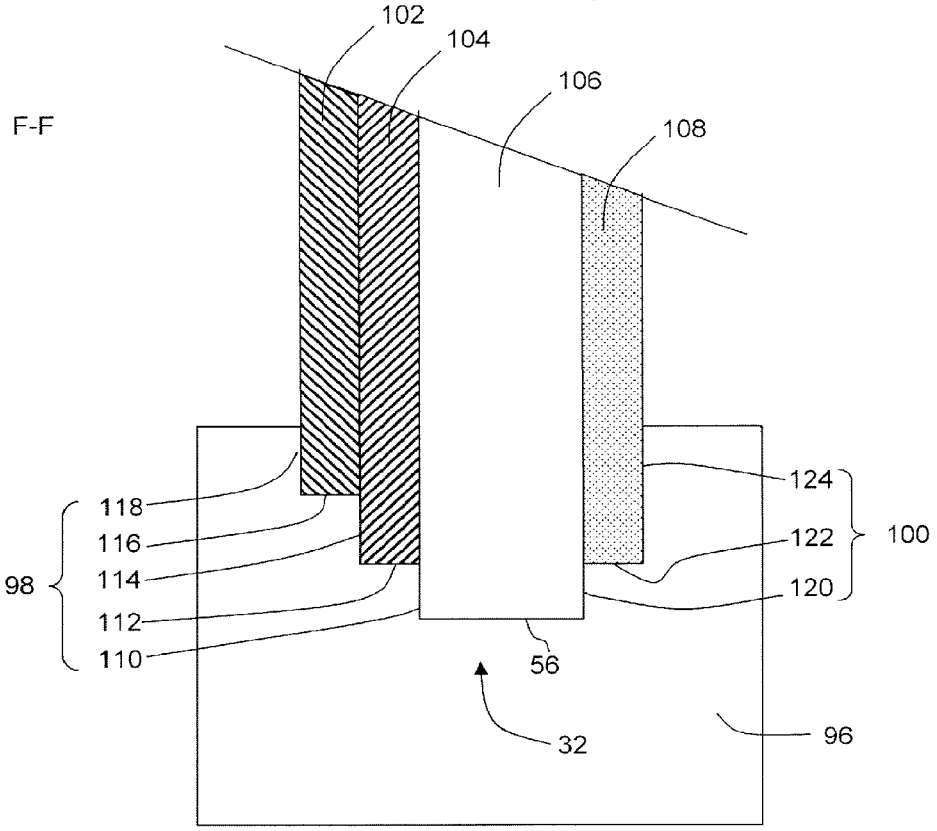
FIG. 19 is a cross-sectional view of the elongated structural member shown in FIG. 18 taken along line F-F.

In FIG. 19, a cross-sectional view is shown taken along line F-F in FIG. 18. The notch 32 is along the length of the elongate member 96 and includes a base surface 56 and two side surfaces 98 and 100. Side surface 100 includes an inner portion 120, a ledge 122 and an outer portion 124. Side surface 100 has one tier to accommodate panel 108 in addition to the first panel 106. The first panel 106 is in contact with the base surface 56. Panel 106 can be, for example, a SIP.

Side surface 98 has more tiers than the other side surface 100. In particular, side surface 98 includes a first surface 110 that is immediately adjacent to the base surface 56. A first ledge 112 connects the second surface 114 to the first surface 110. A second ledge 116 connects the third surface 118 to the second surface 114. The first surface 110 is positioned deepest or most inwardly within the elongate structural member 96, followed by the second surface 114 and least inwardly the third surface 118. The surfaces 110, 114 and 118 are substantially parallel to one another and are each substantially perpendicular to the base surface 56. In another example embodiment, the ledges 112 and 116 are substantially parallel to each other and are each substantially parallel to the base surface 56.

Figure 20:
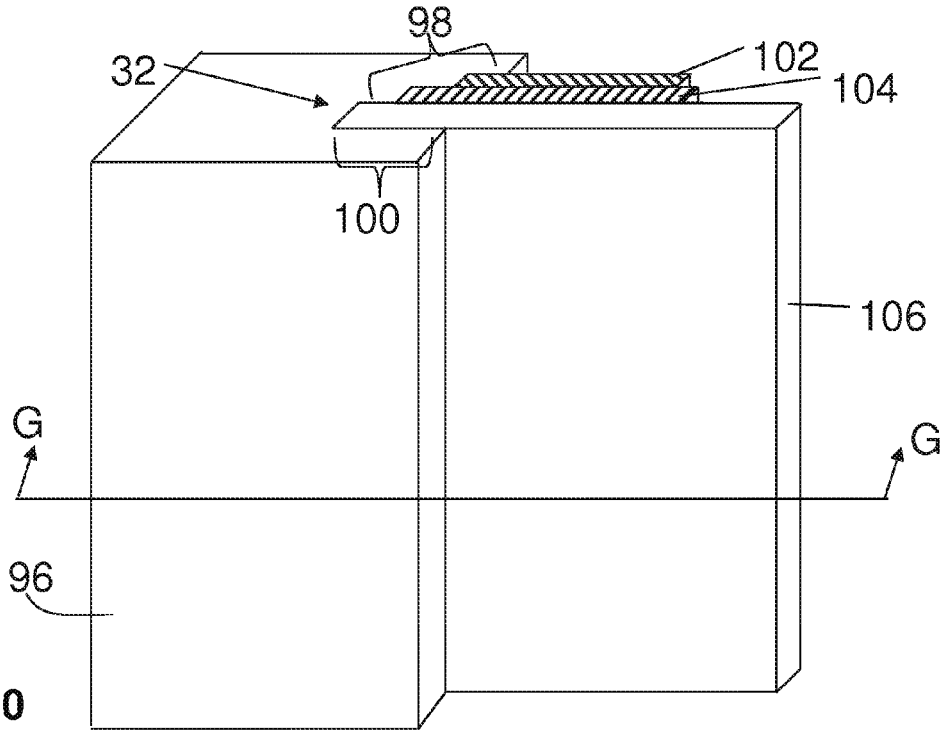
FIG. 20 is a perspective view of an elongated structural member with a notch depicting a tiered side surface and a flat side surface.
Figure 21:
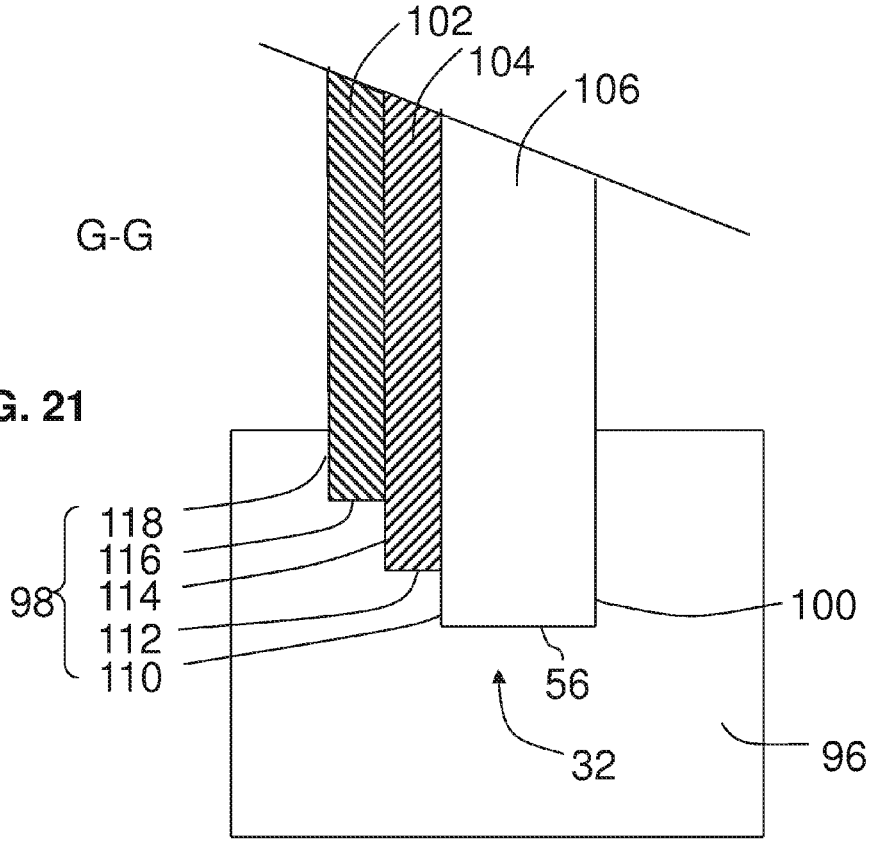
FIG. 21 is a cross-sectional view of the elongated structural member shown in FIG. 20 taken along line G-G.
Figure 22:
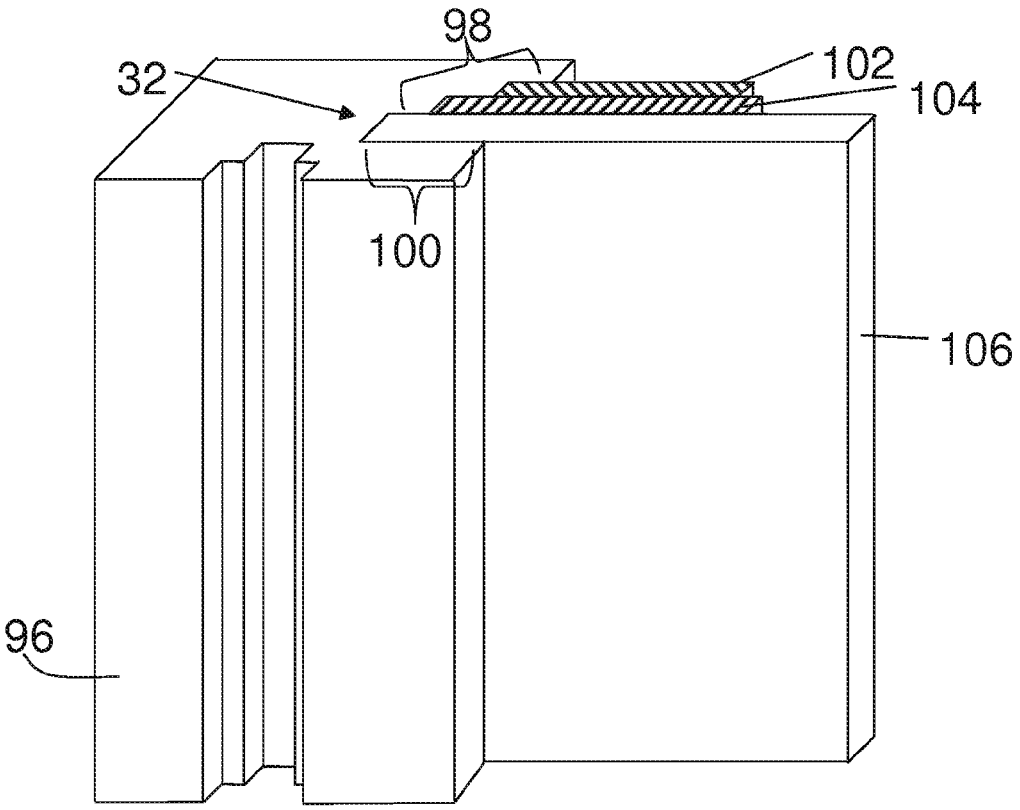
FIG. 22 is a perspective view of an elongated structural member with two notches along the length of the elongated structural member and oriented substantially perpendicular to each other.

The tiered side surface 98 includes multiple outer portions, surfaces 114, 118. Each outer portion that is positioned increasingly further away from the base surface 56 is also positioned increasingly further away from the other side surface 100. This also applies when the other side surface 100 is, for example, flat or tiered. See FIGS. 20, 21 and 22 for a depiction of an example showing that the other side surface 100 is flat. Each of the multiple outer portions in the tiered side surface is configured to accommodate an additional panel.

As seen in FIG. 19, the tiered surface 98 accommodates two additional panels, for example siding or finishing panels 102, 104. Panel 106 is nestled between surfaces 110, 120 and 56. Panel 104 is nestled between the panel 106, the second surface 114 and the first ledge 112. Panel 102 is nestled between the panel 104, the third surface 118 and the second ledge 116.

In another example configuration, the surfaces 118, 114 and 110 are angled relative to each other, and may not be substantially perpendicular to the base surface 56. In another example configuration, the surfaces 118, 114 and 110 are curved surfaces. Similarly, in another example configuration, surfaces or ledges 116, 112, 56 and 122 are curved surfaces.

It can therefore be seen that the notches in the elongate structural members can have various configurations to accommodate multiple panels.

The configuration of the elongate construction member, the post or the beam, and the panels significantly reduces the amount of effort and costs to construct a building. The panels 14 and additional panels, for example siding or finishing panels, can be easily inserted into the tiered notches. For example, the first panel 14 can be moved against the base surface 56, followed by moving an additional panel, for example siding or finishing panels against a ledge 60.

In an example embodiment, the panels 14 or additional panels, for example siding or finishing panels, or both, are affixed to the notches in the elongate member. They can be affixed, for example, by adhesives, spray foam, rubber strips, or combinations thereof. The spray foam may be a mixture of glue and polyurethane.

The panels 14 and additional panels, for example siding or finishing panels, can be large in size, therefore reducing the number of smaller parts. Larger panels help reduce the number of assembly operations, thereby reducing construction time. By contrast, a log wall has many components and requires more assembly operations.

The panels 14 and additional panels, for example siding or finishing panels, can also be cut and fabricated easily to exact dimensions. For example, the panels 14 and additional panels, for example siding or finishing panels, can be pre-fabricated to standardized dimensions, or cut using a computer numerical control machine, or both. The precise dimensioning of the panels 4 and additional panels, for example siding or finishing panels, can be achieved at lower costs than, for example, log walls. Further, the precise dimensioning of the panels 14 and additional panels, for example siding or finishing panels, facilitates a better fit and form when integrating the panels or additional panels with the elongate structural members 80 (e.g. posts and beams).

Cost savings are also achieved by the materials. Panel walls typically cost less than log walls. Moreover, the use of panels reduces the use of trim material, which can be costly.

In general, an elongate structural member defining therein at least one notch is provided. The notch comprises a base surface and two side surfaces at opposite ends of the base surfaces wherein at least one of the side surfaces is tiered and comprises an inner portion and an outer portion that are substantially parallel to each other, the inner portion being substantially perpendicular and immediately adjacent to the base surface and the outer portion being offset from the inner portion and positioned further away from the second side surface than the inner portion; and the notch is configured to receive at least a first panel and a second panel substantially parallel to each other, with at least the base surface and the inner portion of the tiered surface configured to contact the first panel, and at least the outer portion of the tiered side surface configured to contact the second panel.

In another aspect, the notch is defined along the length of the elongate structural member. In another aspect, the notch is defined along the width of the elongate structural member. In another aspect, the second side surface is not tiered. In another aspect, the tiered side surface includes multiple outer portions and each outer portion is positioned increasingly further away from the base surface and increasingly further away from the second side surface. In another aspect, each outer portion in the tiered side surface is configured to accommodate an additional panel. In another aspect, the elongate structural member is any one of a post and a beam. In another aspect, the elongate structural member has a round cross-section. In another aspect, at least two notches are defined along the length of the elongate structural member and oriented substantially perpendicular to each other, a portion of the perimeter of the elongate structural member defined between the two notches is rounded.

There is also provided an assembly integrating an elongate structural member and a panel, wherein the elongate structural member has at least one notch defined within the elongate structural member, the notch comprising a base surface and two side surfaces at opposite ends of the base surface; at least one of the side surfaces is tiered and comprises an inner portion and an outer portion that are substantially parallel to each other, the inner portion being substantially perpendicular and immediately adjacent to the base surface, and the outer portion being offset from the inner portion and positioned further away from the second side surface than the inner portion; and a first panel is positioned within the notch and in contact with at least the base surface and the inner portion of the tiered surface.

In another aspect, the assembly further comprises a second panel positioned within the notch and substantially parallel to the first panel, the second panel in contact with at least the outer portion of the tiered surface. In another aspect, the second panel is a siding panel. In another aspect, the second panel is a finishing panel. In another aspect, the notch is defined along the length of the elongate structural member. In another aspect, the notch is defined along the width of the elongate structural member. In another aspect, the second side surface of the notch is not tiered. In another aspect, the tiered side surface comprises multiple outer portions, and in each outer portion that is positioned increasingly further away from the base surface is also positioned increasingly further away from the second side surface. In another aspect, each outer portion in the tiered side surface is configured to accommodate an additional panel. In another aspect, the elongate structural member is any one of a post and a beam. In another aspect, the elongate structural member has a round cross-section. In another aspect, at least two of the notches are defined along the length of the elongate structural member and oriented substantially perpendicular to each other, and a portion of the perimeter of the elongate structural member defined between the two notches is rounded. In another aspect, the first panel comprises two boards and a polymer material located between the two boards. In another aspect, the two boards are oriented strand boards. In another aspect, the polymer material comprises at least one of polyurethane and polyisocyanurate. In another aspect, the first panel is affixed to the notch with at least one of adhesive, spray foam, and rubber stripping.

The components described herein can be sold as a kit of parts. The kit comprises an elongate structural member having at least one notch defined within the elongate structural member. The notch comprises a base surface and two side surfaces at opposite ends of the base surface, wherein at least one of the side surfaces is tiered and comprises an inner portion and an outer portion that are substantially parallel to each other. The inner portion is substantially perpendicular and immediately adjacent to the base surface. The outer portion is offset from the inner portion and positioned further away from the second side surface than the inner portion. The kit further comprises a first panel that is configured to be positioned within the notch and in contact with at least the base surface and the inner portion of the tiered surface.

While the basic principles of these inventions have been described and illustrated herein it will be appreciated by those skilled in the art that variations in the disclosed arrangements, both as to their features and details and the organization of such features and details, may be made without departing from the spirit and scope thereof. Accordingly, the embodiments described and illustrated should be considered only as illustrative of the principles of the inventions, and not construed in a limiting sense.

The invention claimed is:

1. An elongate structural member defining therein at least two notches along the length of the elongate structural member and oriented substantially perpendicularly to each other, each of the notches comprising a base surface, and a first side surface and a second side surface that are at opposite ends of the base surface, wherein for at least one of the notches:

the first side surface is tiered and the second side surface is not tiered;

the tiered first side surface comprises an inner portion and multiple outer portions that are substantially parallel to each other, the inner portion being substantially perpendicular and immediately adjacent to the base surface and each of the multiple outer portions being offset from the inner portion and positioned increasingly further away from the base surface and increasingly further away from the second side surface; and that notch is configured to receive at least a first panel and a second panel substantially parallel to each other, with at least the base surface and the inner portion of the tiered first surface configured to substantially face the first panel, and at least one of the multiple outer portions of the tiered first side surface configured to substantially face the second panel.

2. The elongate structural member of claim 1, wherein each of the multiple outer portions in the tiered first side surface is configured to accommodate an additional panel.

3. The elongate structural member of claim 1, wherein a portion of the perimeter of the elongate structural member defined between the two notches is rounded.

4. An assembly integrating an elongate structural member and a panel, wherein:

the elongate structural member has at least one notch defined within the elongate structural member, the notch comprising a base surface, and a first side surface and a second side surface that are at opposite ends of the base surface;

the second side surface is not tiered;

the first side surface is tiered and comprises an inner portion and an outer portion that are substantially parallel to each other, the inner portion being substantially perpendicular and immediately adjacent to the base surface, and the outer portion being offset from the inner portion and positioned further away from the second side surface than the inner portion;

the tiered first side surface comprises multiple outer portions, each of the multiple outer portions positioned increasingly further away from the base surface and increasingly further away from the second side surface; and a first panel is positioned within the notch and is substantially facing at least the base surface and the inner portion of the tiered first side surface.

5. The assembly of claim 4, further comprising a second panel positioned within the notch and substantially parallel to the first panel, the second panel is facing at least one of the multiple outer portions of the tiered first side surface.

6. The assembly of claim 4, wherein each of the multiple outer portions in the tiered first side surface is configured to accommodate an additional panel.

7. The assembly of claim 4, wherein:

at least two of the notches are defined along at least part of the length of the elongate structural member and oriented substantially perpendicular to each other; and a portion of the perimeter of the elongate structural member defined between the two notches is rounded.

8. The assembly claim 4, wherein the first panel comprises two boards and a polymer material located between the two boards.

9. The assembly of claim 8, wherein the two boards include at least one of oriented strand boards, magnesium oxide boards, hemp boards, vinyl boards and drywall.

10. The assembly of claim 8, wherein the polymer material comprises at least one of polyurethane and polyisocyanurate.

11. A kit of parts for integrating an elongate structural member and a panel, the kit comprising:

an elongate structural member having at least one notch defined within the elongate structural member, the notch comprising a base surface, and a first side surface and a second side surface that are at opposite ends of the base surface, wherein the second side surface is not tiered, the first side surface is tiered and comprises an inner portion and multiple outer portions that are substantially parallel to each other, the inner portion being substantially perpendicular and immediately adjacent to the base surface, and each of the multiple outer portions being offset from the inner portion and positioned increasingly further away from the base surface than the inner portion and increasingly further away from the second side surface; and a first panel is configured to be positioned within the notch and to substantially face at least the base surface and the inner portion of the tiered first side surface.

12. The kit of parts of claim 11, further comprising a second panel configured to be positioned within the notch and substantially parallel to the first panel, the second panel being in contact with at least the outer portion of the tiered first surface.

13. The kit of parts of claim 11, wherein each outer portion in the tiered first side surface is configured to accommodate an additional panel.

14. The kit of parts of claim 11, wherein:

at least two of the notches are defined along the length of the elongate structural member and oriented substantially perpendicular to each other; and a portion of the perimeter of the elongate structural member defined between the two notches is rounded.

15. The kit of parts claim 11, wherein the first panel comprises two boards and a polymer material located between the two boards.

16. The kit of parts of claim 15, wherein the two boards include at least one of oriented strand boards, magnesium oxide boards, hemp boards, and vinyl boards, and drywall.

17. The kit of parts of claim 15, wherein the polymer material comprises at least one of polyurethane and polyisocyanurate.

18. An assembly integrating an elongate structural member and a panel, wherein:

the elongate structural member has at least one notch defined within the elongate structural member, the notch comprising a base surface, and a first side surface and a second side surface that are at opposite ends of the base surface;

the first side surface is tiered and comprises an inner portion and an outer portion that are substantially parallel to each other, the inner portion being substantially perpendicular and immediately adjacent to the base surface, and the outer portion being offset from the inner portion and positioned further away from the second side surface than the inner portion;

the tiered first side surface comprises multiple outer portions, each of the multiple outer portions positioned increasingly further away from the base surface and increasingly further away from the second side surface; and a first panel is positioned within the notch and is substantially facing at least the base surface and the inner portion of the tiered first side surface, and the first panel comprises two boards and a polymer material located between the two boards.

19. The assembly of claim 18, wherein the two boards include at least one of oriented strand boards, magnesium oxide boards, hemp boards, vinyl boards and drywall.

20. The assembly of claim 18, wherein the polymer material comprises at least one of polyurethane and polyisocyanurate.

21. A kit of parts for integrating an elongate structural member and a panel, the kit comprising:

an elongate structural member having at least one notch defined within the elongate structural member, the notch comprising a base surface, and a first side surface and a second side surface that are at opposite ends of the base surface, wherein the first side surface is tiered and comprises an inner portion and multiple outer portions that are substantially parallel to each other, the inner portion being substantially perpendicular and immediately adjacent to the base surface, and each of the multiple outer portions being offset from the inner portion and positioned increasingly further away from the base surface than the inner portion and increasingly further away from the second side surface; and a first panel configured to be positioned within the notch and to substantially face at least the base surface and the inner portion of the tiered first side surface, the first panel comprising two boards and a polymer material located between the two boards.

22. The kit of parts of claim 21, wherein the two boards include at least one of oriented strand boards, magnesium oxide boards, hemp boards, and vinyl boards, and drywall.

23. The kit of parts of claim 21, wherein the polymer material comprises at least one of polyurethane and polyisocyanurate.

* * * * *